US005787541A

United States Patent [19]

Chen

[11] Patent Number: 5,787,541

[45] Date of Patent: Aug. 4, 1998

[54] BATHING SCRUBBER WITH MASSAGE BALLS

[76] Inventor: Kuo-Chin Chen, Jui An Street Ta An District, Taipei, Taiwan

[21] Appl. No.: 908,481

[22] Filed: Aug. 6, 1997

[51] Int. Cl.[6] ..... A47K 7/02; A61H 7/00

[52] U.S. Cl. ..... 15/222; 15/209.1; 15/210.1; 601/137; 601/138

[58] Field of Search ..... 15/209.1, 210.1, 15/222; 601/135, 136, 137, 138

[56] References Cited

U.S. PATENT DOCUMENTS

| | | | |
|---|---|---|---|
| 2,154,831 | 4/1939 | Booharin | 15/222 |
| 4,936,294 | 6/1990 | Chu | 601/136 |
| 5,545,456 | 8/1996 | Suida | 15/222 |

FOREIGN PATENT DOCUMENTS

| | | | |
|---|---|---|---|
| 2616655 | 12/1988 | France | 601/136 |

*Primary Examiner*—Randall Chin

*Attorney, Agent, or Firm*—Pro-Techtor Inter-National Services

[57] ABSTRACT

Disclosed is a bathing scrubber with massage balls mainly including a bag body and a plurality of massage balls contained in the bag body. The bag body is formed from a pad and a main body sewed together at three edges with one edge left opened. The main body is formed from multiple layers of elastic net-like fabrics and forms a cleansing surface of the bathing scrubber. The open edge of the bag body can be closed by folding a sewing edge provided on the pad to overlap the main body and thereby seal the massage balls in the bag body. Buttons are correspondingly sewed on the pad and the main body among every four adjacent massage balls. Each pair of corresponding buttons are associated with one another by a thread in adequate length threaded through the buttons. Therefore, each individual massage ball is rotatably confined in a small space defined by the buttons around the massage ball. When the bag body of the bathing scrubber is used to clean a user's skin, the elastic net-like fabrics of the main body gently but effectively scrub the skin to remove dirt while the massage balls in the bag body freely rotate among the buttons to massage the skin.

3 Claims, 5 Drawing Sheets

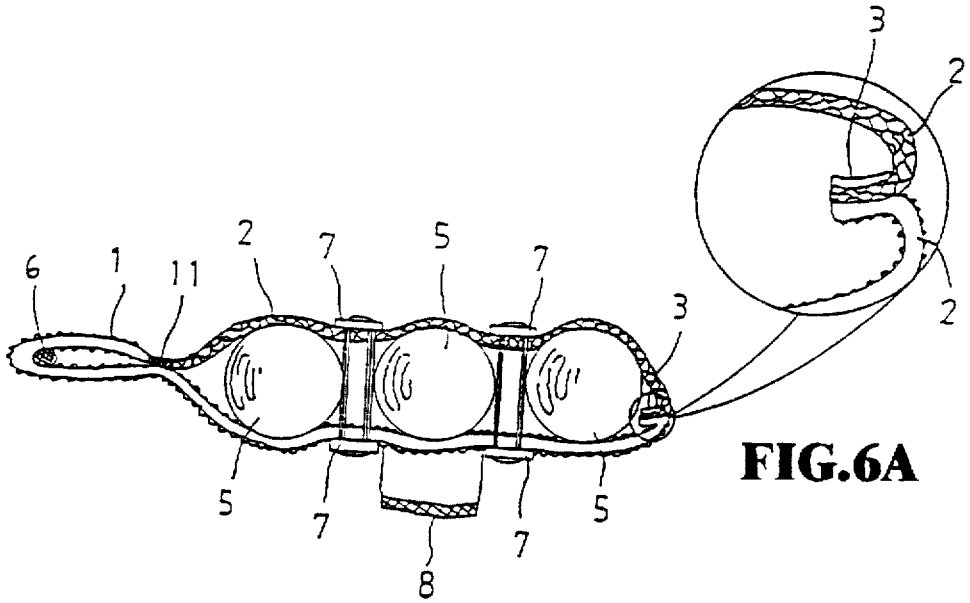
FIG.6A
FIG. 6
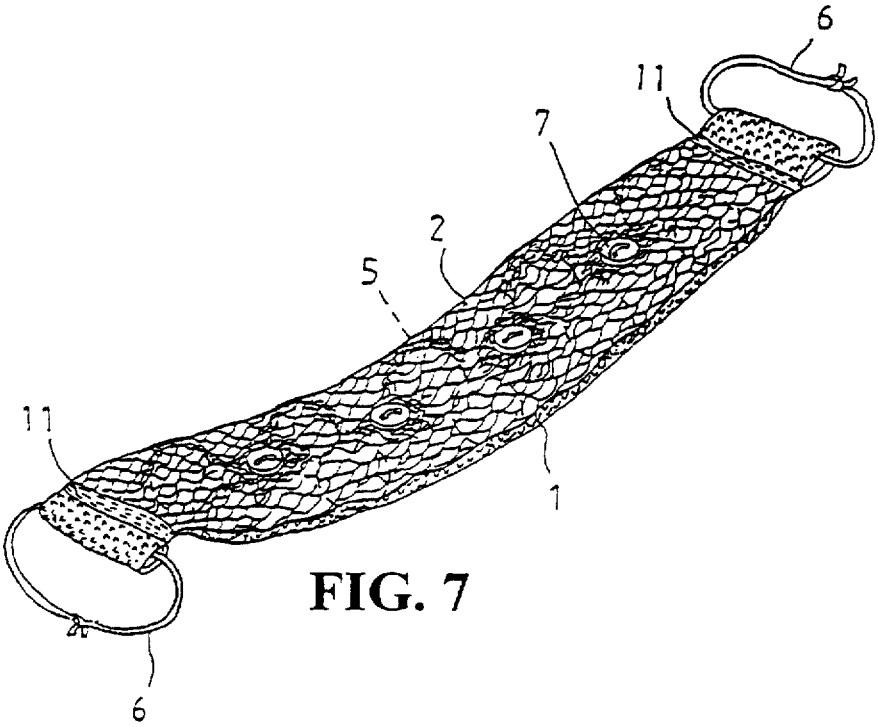
FIG. 7

BATHING SCRUBBER WITH MASSAGE BALLS

BACKGROUND OF THE INVENTION

The present invention relates to a bathing scrubber with massage balls, and more particularly to a bathing scrubber which includes a bag body formed from multiple layers of elastic net-like fabrics and a plurality of massage balls sealed in the bag body, so that the bathing scrubber can be used as a cleansing and massaging means.

There are many kinds of body cleansing means available in the market, such as soft hair brush, bath loofah, ball sponge, etc. These body cleansing means have following disadvantages:

1. When a user employs such body cleansing means to forcefully and frictionally scrub his or her body for the purpose of removing dirts on the body, such body cleansing means might cause uncomfortableness to the user.
2. These body cleansing means can only be used to cleansing body without massage effect and therefore can not help the user to completely recover from tiredness during bathing.
3. These body cleansing means are not stretchable or contractible and therefore, they can only superficially and frictionally contact with the skin. The cleaning effect of these body cleansing means can not deeply reach into the pores.

It is therefore desirable to develop a body cleansing means that can eliminate the above-mentioned drawbacks existed in the conventional body cleansing means.

SUMMARY OF THE INVENTION

A primary object of the present invention is to provide a bathing scrubber, a main body of which is formed from multiple layers of elastic net-like fabrics to provide a stretchable and contractible contact surface to clean a user's skin. Meshes on the main body keep changing in their shape while the bathing scrubber stretches and/or contracts and can therefore thoroughly clean the user's skin.

Another object of the present invention is to provide a bathing scrubber which is in a form of a bag formed by sewing a pad and a main body constructed from multiple layers of elastic net-like fabrics together to contain a plurality of massage balls in the bag. The massage balls rotate in the bag when the bathing scrubber is used to scrub about the user's skin, producing a massage effect to help the user to recover from tiredness.

BRIEF DESCRIPTION OF THE DRAWINGS

The means adopted by the present invention to achieve the above and other objects can be best understood by referring to the following detailed description of the preferred embodiments and the accompanying drawings, wherein

FIG. 6 is a sectional view of the bathing scrubber taken on line A—A of FIG. 4; and FIG. 6A is a magnified view of an end of the bathing scrubber.

FIG. 7 is another embodiment of the present invention.

DETAILED DESCRIPTION OF THE PREFERRED EMBODIMENTS

Figure 1:
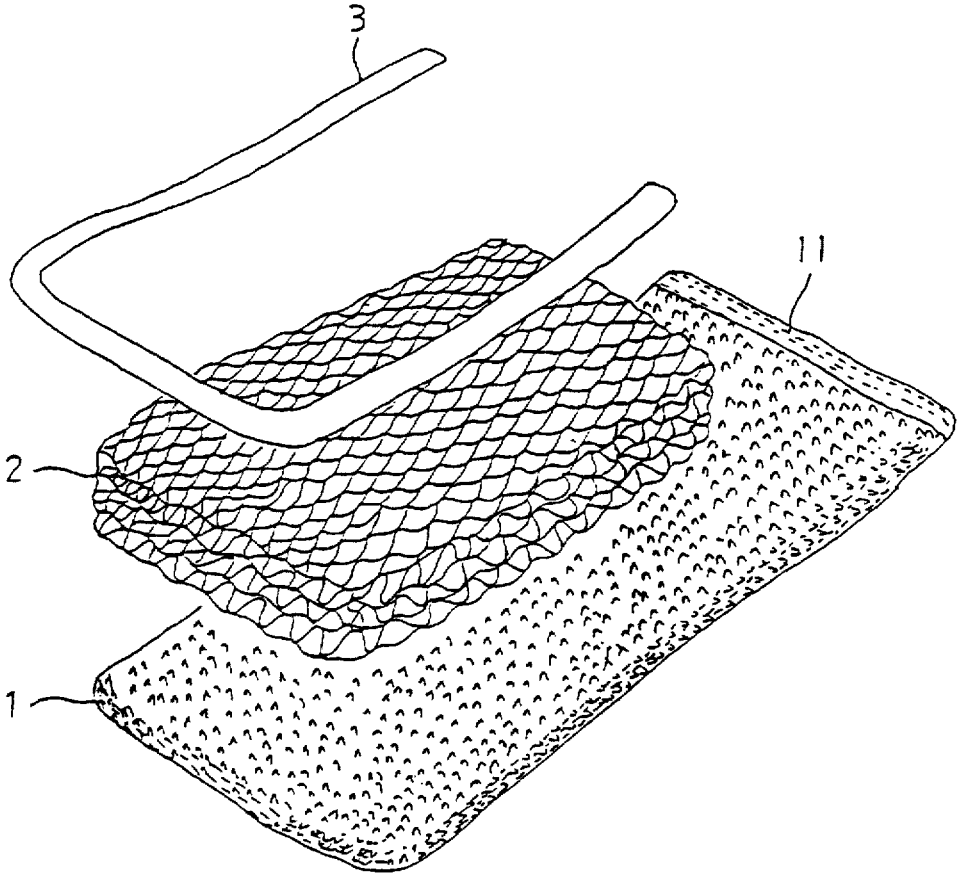
FIG. 1 is an exploded perspective showing components for forming the bag of the present invention.

Please refer to FIG. 1 which illustrates basic components for forming a bag body of the bathing scrubber according to the present invention. As shown in the drawing, these basic components include a piece of pad 1, a stretchable and contractible main body 2 formed from multiple layers of elastic net-like fabrics, and a trimming strip 3 in adequate length. The pad 1 is provided at one transverse end with a sewing edge 11.

Figure 2:
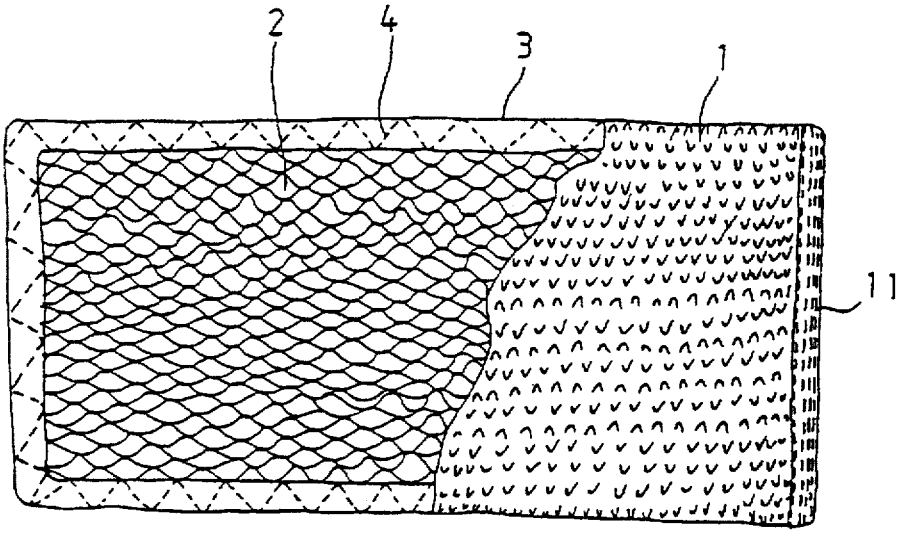
FIG. 2 shows the manner in which the components of FIG. 1 are sewed together to form the bag of the present invention.

Please now refer to FIG. 2 which generally shows a bag body formed by sewing the components of FIG. 1 together. When sewing these components together, first put the multi-layer net main body 2 over the pad 1. Then, use the trimming strip 3 to wrap three sides of the overlapped pad 1 and main body 2, and use a thread 4 to sew up these three sides, leaving an opening between a fourth side of the main body 2 and a portion of the pad 1 having the sewing edge 11. The multiple layers of net-like fabrics forming the main body 2 produce numerous staggered meshes in the main body 2. The staggered meshes allow the main body 2 to have numerous size-reduced openings which change in their shapes with the stretch and contraction of the whole bathing scrubber when it is used for cleansing skin, and thereby provide better cleansing effect.

Figure 3:
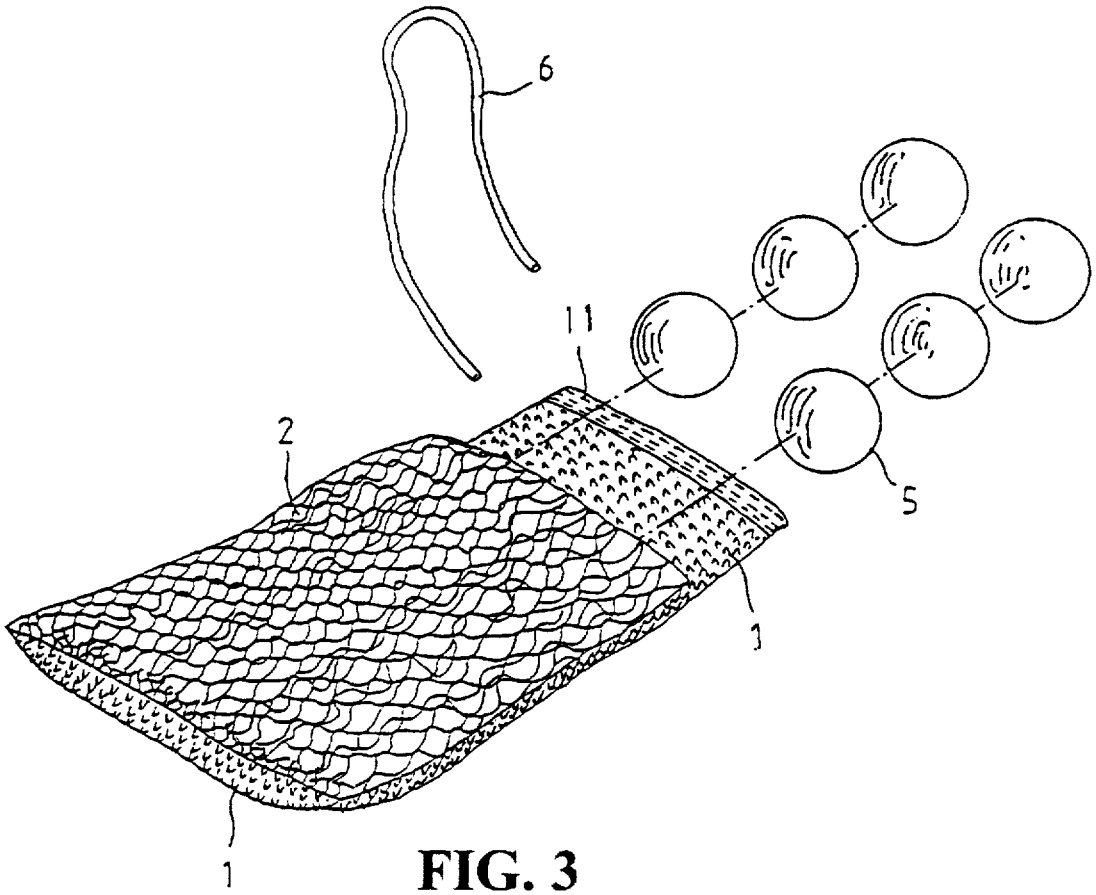
FIG. 3 shows the bag of FIG. 2 being turned inside out and the manner in which the massage balls are placed into the bag.

Please refer to FIG. 3. The bag formed according to the above described manner is turned inside out, so that the three sewed sides locate inside the turned bag and are not visible from outside of the bag. Then, a plurality of massage balls 5 in even numbers are put into a space defined by the bag. Finally, the portion of the pad 1 with the sewing edge 11 is folded to close the opening between the main body 2 and the pad 1 and the sewing edge 11 is sewed onto the main body 2 below it, sealing the massage balls 5 in the bag. A string 6 can be extended through a clearance left between a folding line on the pad 1 and the sewing edge 11 sewed onto the main body 2 with two ends of the string 6 tied together to form a loop.

Figure 4:
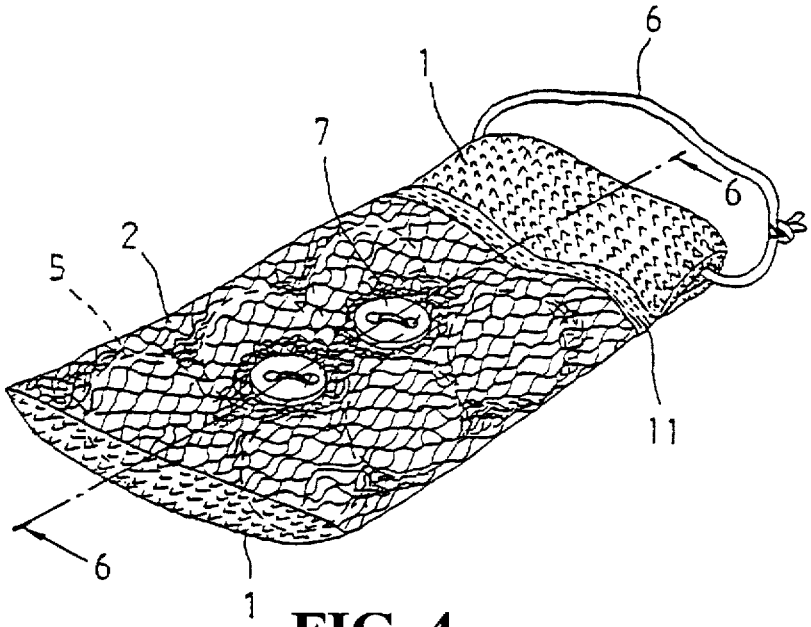
FIG. 4 illustrates a bathing scrubber with massage balls according to the present invention.
Figure 5:
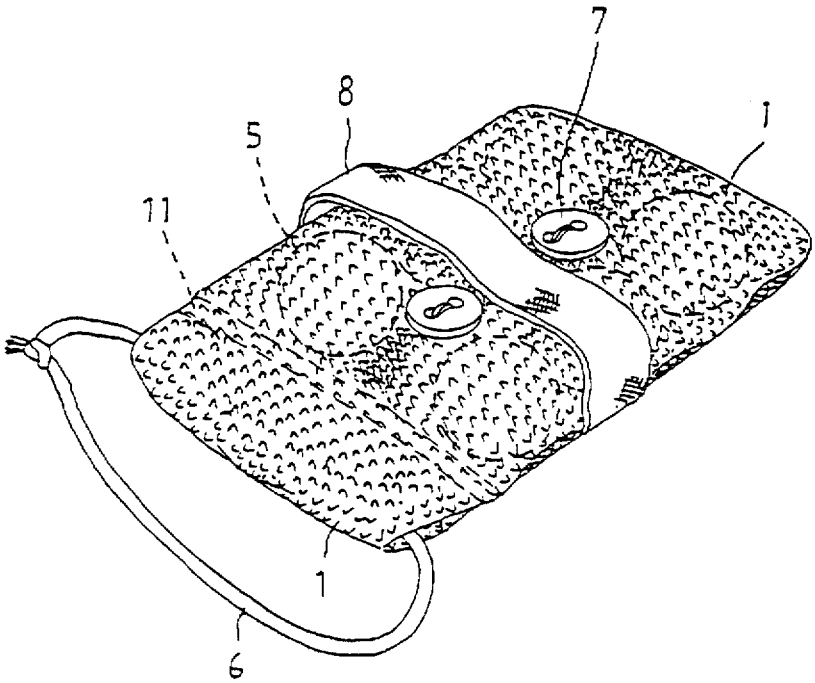
FIG. 5 illustrates a reverse side of the bathing scrubber of FIG. 4.

Please refer to FIGS. 4, 5, and 6 at the same time. Buttons 7 are correspondingly sewed to the bag on the main body 2 and the pad 1 among every four adjacent massage balls 5. Each pair of corresponding buttons on the pad 1 and the main body 2 are associated with one another by a thread in adequate length threaded through the buttons, so that each individual massage ball 5 is rotatably confined in a small space between the pad 1 and the main body 2 defined by the associated buttons around it. At this point, a bathing scrubber with massage balls is formed. A hand strap 8 is connected at two ends to two sides of the bag near two middle points thereof to extend across a top of the pad 1, so that a user may extend his or her one palm below the hand strap 8 to conveniently scrub skin with the bathing scrubber formed from the above steps.

The main body 2 formed from multiple layers of elastic net-like fabrics forms a cleansing surface of the bathing scrubber of the present invention, while the pad 1 sufficiently frictionally contacts with the user's palm to act as a means to allow smooth movement of the bathing scrubber over the skin. When the bathing scrubber smoothly moves about the user's body to clean the skin with the main body of multiple layers net-like fabrics, the massage balls 5 inside the bathing scrubber rotate in their respective small space confining them to stretch and/or squeeze meshes on the net-like fabrics, allowing the staggered and frequently deformed meshes to gently but effectively scrub dirt away from the user's body.

FIG. 7 illustrates another embodiment of the present invention. In this embodiment, the bathing scrubber is in a form of a long belt with two sewing edges formed at two transverse ends of the pad 1. More massage balls 5 can be disposed in the bathing scrubber and be individually rotatably confined in a small space in the manner as used in the first embodiment. With two sewing edges 11 provided at two ends of the bathing scrubber which can be turned to overlap the main body 2, there are two gaps provided at two ends of the bathing scrubber for two strings 6 to separately extend through and form two loops for convenient grip by hands. The bathing scrubber according to this second embodiment is particularly suitable for scrubbing a user's back.

What is claimed is:

1. A bathing scrubber with massage balls, comprising a pad and a main body formed from multiple layers of elastic net-like fabrics, said pad and said main body being overlapped and sewed together along three edges thereof to form a bag having an opening at one end, said bag being turned inside out and defining a space into which a plurality of massage balls are disposed, said pad being provided at an end near said opening with a first sewing edge which is folded to overlap a top portion of said main body near said opening after said massage balls are put in said bag, said folded first sewing edge being sewed onto said main body to seal said massage balls in said bag while providing a clearance on said bag for a first string to extend through and form a first loop; buttons being correspondingly sewed to said bag on said main body and said pad among every four adjacent massage balls, each pair of said correspondingly sewed buttons being associated with one another by means of a thread in adequate length threaded through said buttons, such that each of said massage balls is rotatably confined in a small space between said pad and said main body defined by said associated buttons sewed around said massage ball; and a hand strap being connected at two ends to two sides of said bag near middle points thereof to extend across a top of said pad for a user's palm to extend therethrough.

2. A bathing scrubber with massage balls as claimed in claim 1, wherein said pad and said multiple layers of elastic net-like fabrics of said main body are sewed together at three edges by wrapping a trimming strip of adequate length along said three edges and sewing said trimming strip, said pad, and said main body together by means of a thread.

3. A bathing scrubber with massage balls as claimed in claim 1, wherein said bag formed by sewing said pad and said main body together is an elongated bag for accommodating a large number of said massage balls therein, said elongated bag having an additional second sewing edge provided at another end thereof opposite to said first sewing edge, said second sewing edge being folded to overlap another top portion of said main body and forming another clearance for a second string to extend therethrough and form a second loop.

* * * * *